US006534720B2

(12) United States Patent
Von Alpen et al.

(10) Patent No.: US 6,534,720 B2
(45) Date of Patent: Mar. 18, 2003

(54) DEVICE FOR CONNECTING A WINDOW WITH ELECTRICAL FUNCTIONS

(75) Inventors: Ulrich Von Alpen, Aachen (DE); Martin Englmeier, Lenting (DE); Detlev Dürkop, Hurth (DE)

(73) Assignee: Saint-Gobain Glass France, Courbevoie (FR)

( * ) Notice: Subject to any disclaimer, the term of this patent is extended or adjusted under 35 U.S.C. 154(b) by 0 days.

(21) Appl. No.: 09/765,649

(22) Filed: Jan. 22, 2001

(65) Prior Publication Data

US 2003/0034172 A1 Feb. 20, 2003

(30) Foreign Application Priority Data

Jan. 22, 2000 (DE) ..... 100 02 777

(51) Int. Cl.[7] ..... H01B 17/00

(52) U.S. Cl. ..... 174/149 R; 174/138 R; 343/711

(58) Field of Search ..... 174/149 R, 138 R, 174/138 G, 152 A, 153 A; 52/110; 343/711

(56) References Cited

U.S. PATENT DOCUMENTS 3,646,561 A * 2/1972 Clarke ..... 343/711
4,721,964 A * 1/1988 Sato et al. ..... 343/713
5,083,135 A * 1/1992 Nagy et al. ..... 343/713
5,528,314 A * 6/1996 Nagy et al. ..... 343/713
5,712,645 A * 1/1998 Jellum et al. ..... 343/713
5,739,794 A * 4/1998 Nagy et al. ..... 343/713
5,959,581 A * 9/1999 Fusinski ..... 343/700 MS
6,097,345 A * 8/2000 Walton ..... 343/769
6,266,023 B1 * 7/2001 Nagy et al. ..... 343/713
6,268,832 B1 * 7/2001 Twort et al. ..... 343/713
6,307,515 B1 * 10/2001 Sauer et al. ..... 343/713

* cited by examiner

*Primary Examiner*—Dean A. Reichard
*Assistant Examiner*—W. David Walkenhorst
(74) *Attorney, Agent, or Firm*—Oblon, Spivak, McClelland, Maier & Neustadt, P.C.

(57) ABSTRACT

In a device for connecting several functional electric elements arranged on a transparent window, such as antennas for example, by a single flexible cord element and of its connection conductors to sets which follow, the contact faces (10) of the functional elements (3, 4) that are to be connected by means of this contact element (8) are distributed along the edge of the window (1), the contact element has a shape tailored to the edge of the window (1) and also acts as a support for circuit elements (9) arranged in close proximity to the contact faces (10) and is electrically connected thereto.

22 Claims, 2 Drawing Sheets

DEVICE FOR CONNECTING A WINDOW WITH ELECTRICAL FUNCTIONS

CROSS REFERENCE TO RELATED APPLICATIONS

The present application is based on German patent application 100 02 777.6, filed Jan. 22, 2000, which is herein incorporated by reference in its entirety.

BACKGROUND OF THE INVENTION

Field of the Invention

The invention relates to a device for connecting a window, particularly a window for a motor vehicle, with certain electrical functions.

Document DE-C1 195 36 131 discloses a diversity window antenna with connecting elements, which is preferably used for vehicles. The antenna elements and the antenna conductor structures, are deposited on the surface of a window by screen printing and are baked on when the window is heated before it is toughened. There are a number of antennas on the same window, so that incident transmitters having various directions of reception can be used, and the transmitter with the optimum field intensity is selected automatically each time.

In the configuration disclosed by that document, connection points of the individual antennas are grouped together locally at the edge of the window. A multiple contact element in the form of a length of special flat cable is placed at this point and, for each connection, comprises a mating contact in addition to the corresponding conductor. The electrical signals from the antennas are transmitted along these conductors to the respective amplifiers located remotely from the window.

Simple AM/FM antennas have been made in windscreens, side windows or rear screens for a number of years, either by placing metal wires in the laminated safety glass windscreen or by using conductive structures printed onto single-pane safety glass in the case of the side windows or rear window. It has also been known to use the heating area of rear screens to make an antenna. For connection to the sets (receivers), use is also frequently made of plug-in connectors or spring contacts.

It is also known (DE-GM 75 27 621) for a unit contacting the amplifier to be bonded onto the window glass so as to make a direct connection between an antenna amplifier and antenna conductors placed on a window glass. Two antenna conductors in conducting connection with one another inside the amplifier unit are connected directly to the input terminals of the amplifier and are also bonded to the window glass. On the output side, the amplifier is connected by a flat multicore cable to the on-board network (supply voltage) and the receiver apparatus.

DE-C2-43 04 788 discloses a multilayer conducting structure for connecting functional electric elements arranged on a car window, such as window antennas for example, and which can be connected to the on-board network of the vehicle using a connection element of the push-button type which is soldered onto an opaque edge region of the window.

Future development in vehicle driver information requirements, with the increase in traffic density, has led to the networking of various information systems with a view to intelligently managing the flow of vehicles in such a way that, for example, their position can be exactly determined using a global positioning system (GPS) in conjunction with automatic rotate planning, and stationary installations for measuring traffic flow can allow this objective to be pursued in the optimum way. Furthermore, there has been research into the automatic transmission of messages analyzing accidents and theft, video games in the passenger seat, ranging as far as Internet connections inside the vehicle. The future role of the vehicle driver as an active and passive participant in a broad wireless information and communications network entails the development of corresponding on-board receiver systems which activate the information systems in the vehicle. These receiver systems comprise the built-in antenna systems for the individual communications services including the electronics needed for the amplifiers and impedance matchers, respectively.

The information systems currently used in vehicles are AM and FM radio transmitters, UHF video transmitters, GSM telephones and GPS navigation aids. Hitherto, these have been connected to individual networks partially by separate stick-like, spherical or crescent-shaped antennas.

The fixture may conceivably, in addition to the networking of the systems, see developments in which bulletins giving weather and road conditions, DAB (digital radio), Internet connections, network monitoring in the form of accident or theft analysis or telesurveillance, etc. also communicate via a wireless connection with the occupants and respectively with the equipment of the vehicle.

Such a multitude of installed systems leads to a corresponding multitude of antennas. Installing these externally on the vehicle is undesirable both from an aesthetic point of view and for reasons associated with possible breakdowns due to damage. Development trends are therefore oriented towards invisible installation of antenna systems on electrically insulating regions of the bodywork such as parts made of glass or plastic, for example. The incorporation of complicated antenna structures in vehicle window glass is dictated because of the large expanse of glass or plastic surfaces and because of the ideal dielectric properties of glass or suitable plastics.

For vehicles with the engine at the front, positioning the antenna systems on the rear screen or rear window proves the optimum solution for reasons of electromagnetic compatibility, whereas such systems are preferably installed in the windscreen in vehicles with mid-rear-mounted engines and also those with convertible bodywork.

All the systems have to meet the requirement of panoramic reception with as little disturbance as possible. Using a two-dimensional antenna to secure this can be achieved only through the fact that, in each position of the vehicle, the optimum position of the antenna with the strongest signal is selected using a controller from a diverse multitude of antennas in various positions on the window (diversity system) and introduced into the on-board information systems. The number of individual diversity systems needed depends on the geometric configuration, on the specific electromagnetic compatibility of the vehicle, and on the possibility of obtaining high signal intensities by mixing signals (phase-amplitude sum).

The integration of numerous antenna systems into a car window, if appropriate, in conjunction with heating elements, requires suitable connections between the reception systems and the communication sets which follow. Conventional flat connection systems cannot be used as they are, because many car windows have a highly complex shape in which, in particular, the edges of the windows may be spherically curved and with relatively small radii. Furthermore, the connection systems to be used have to meet strict motor industry standards regarding stability with respect to inclement weather and with respect to temperature and ability to withstand vibration, etc.

The conventional technique of electrical connection by screen printing onto glass cannot be applied in all cases because of the porosity of the conducting structures thus produced, which may lead to the absorption of moisture from the environment of the vehicle and thus to electro-corrosion or even short circuits.

According to another requirement, the antenna amplifier and the impedance matcher ought to be positioned as close as possible to the individual antenna bases in order to guarantee reception which is as good as possible with a broad protection margin. In complicated systems of this type, the antenna bases ought to be located at relatively large distances from one another on the face of the window because, particularly in diversity systems, there is a strong dependency between the intensity of a field detectable on a window antenna and the direction of radiation of the transmitter concerned.

Window antenna systems are also known (DE-A1 39 11 178) in which electric components are placed directly on, in or in proximity to, a vehicle window, and all the antenna signals and supply voltages are supplied by a single wiring harness made up of high-frequency conductors and supply lines. It is necessary to have a window antenna which can be installed as a complete unit in the bodywork of the vehicle and which is electrically connected to the bodywork, and to the network associated with the bodywork, merely by a single multiple connection in the form of a wiring harness. Antenna amplifiers (of the quadripole type) of this system are, however, fixed directly to the window and soldered to the input and output lines made thereon by screen printing.

SUMMARY OF THE INVENTION

It is an object of the invention to provide a connecting device which makes it possible, in a simplified way, to connect electrical functions arranged on a window in a decentralized manner, particularly antenna elements.

According to the invention, this and other objects are advanced by a connecting device in a window unit comprising a transparent window and at least two functional electric elements mounted on said transparent window, each of the functional electric elements being provided with an electrical contact face arranged on the window near the edge of the window, the connecting device comprising a contact element in the form of a body mounted to the window at the edge of the window, the body covering the contact faces; at least two conductors insulated from one another and arranged in the body; and a circuit element supported by said body, wherein the conductors are positioned to make electrical connection with at least one of said electrical contact faces of said functional electric elements covered by said body and said circuit element.

Thus, the connection faces of the functional electric elements are distributed along the edge of the window, particularly in its corner regions. So the connection conductors can be shortened. Furthermore, the contact element has a shape tailored to the line of the edge of the window so that it can easily follow the curvature of the fixed window. Its mating contacts may be applied, in the mounted position, to the position of the connection faces connected to the window. Finally, on the contact element in close proximity to the mating contacts, there are circuit elements mounted electrically, such as electronic modules for example, particularly amplifiers. The body of the contact element is thus used not only as an insulation or sheath for the conducting tracks on lines which run through it, but also as a support for the circuit elements. The body of the contact element may be made up of a laminate of several layers.

In use on car window glass the dimensions of the contact element on the face of the window and, in particular, on the area of the edge thereof, are limited because the field of view through the window must not be impaired. The total length of the contact element is dimensioned according to requirements. It is possible to use not only contact elements in the form of bands extending along one of the upper and/or lower edge faces of the window, but also along one or two lateral edge faces and, if appropriate, also just along part of the edge faces, and finally also versions in the shape of an L or U. Their external dimensions are essentially predetermined by the number, arrangement and mutual distances of the connection or contact faces for functional elements in the region of the edge of the window.

Corner pieces along the line of the contact element may be made from a piece homogeneous therewith, or the conductor passing through this point may be produced by separate corner connectors which subdivide the contact element into several sections. Such corner connectors can be combined with the connection points needed between the conductors or the contacts element and the functional elements on the window.

As a preference, the application and connection regions provided in the contact element for the circuit elements (unit, electronic modules) are strengthened so as to allow them to be manufactured by robots as appropriate. Such strengthening may be achieved by local increased thicknesses of material, locally limited rigid inserts in the contact element which elsewhere is flexible, or by fitting rigid additional parts above or below them.

To assemble the contact element with the window, use is preferably made of a layer of adhesive. This may be a single layer which has been deposited on just one side on the underside of the contact element, which has to be applied to the window, respectively on the edge band thereof. In another embodiment, the layer of adhesive may be a piece of double-sided sticky tape, one side of which is bonded to the underside of the contact elements and the other side of which is bonded to the edge band. An isoprene or acrylate adhesive may be used as the adhesive.

Likewise, the individual mating contacts intended for the respective connection face on the window (for example the antenna bases) are preferably pre-equipped with solder or conducting adhesive, so as to simplify the making of the respective connections. If these have to be made by soldering, then the material of the support for the contact element or, respectively, the conducting sheet itself, will be made of a material which resists heat, for example the plastic polyimide. If the electrical contacts to the window are to be made by bonding, then there is less restriction in the choice of materials for the support sheet as far as temperature sensitivity is concerned.

It is also possible to provide appropriate positioning accessories on the contact element, these clearly defining in advance its orientation and its position on the edge of the window, and its distance from this edge, and thus assisting with mounting and making the latter easier. These accessories may for example be end-stops to be placed on the frontal edge face of the window. They may be assembled rigidly, possibly as a single piece with the body of the contact element. When the frontal edge faces of the window have to be unimpeded all the way around in the mounted state, these mounting accessories may be assembled with the contact element or with the matrix thereof, for example by means of ribs equipped with areas of lower strength. These can rapidly and easily be detached once the contact element has been definitively placed on the window, so as to remove the stops which have now become unnecessary.

The respective electrical contacts may also be made by means of mechanically joined assemblies, for example of the push-button type, which are also already known for this type of application. They may furthermore be used, on the one hand, as positioning accessories in the sense already mentioned and, on the other hand, do not preclude combined additional assembly by soldering or bonding.

In a particularly preferred embodiment of an application to a transparent window, the flexible contact element is bonded onto an edge region of the window, which region is covered with an opaque screen-printed area in the form of a surround. Such decorative surrounds are customary on all window glasses designed to be bonded directly onto the bodywork, to prevent the adhesive used from being seen and to prevent the adhesive from being degraded by UV radiation. When such a window is in the mounted state, this opaque coating is covered with interior trim elements towards the interior space of the vehicle, over a width such that the contact element is not visible from the inside. A preferred embodiment relates to a rear screen, which in its upper region has a screen-printed band more then 20 mm wide, which is suited to a pre-existing flexible conducting sheet.

In total, in the opaque printed region the edge of the window, it is possible to have a flexible structure entirely electrically integrated with conducted channels or bundle of cables, including all the electronics modules, which is entirely covered by the interior trim that is to be mounted later. This structure maintains a distance greater that 6 mm away from the edge of the window, this distance being predetermined by the deposition of the bead of adhesive for bonding the window into the bodywork, including any premounted surround.

Aside from its function of supporting the circuit elements, modules and conducting channels, the printed circuit may also, in special embodiments, itself constitute a support for other antenna structures. Such antenna structures on the face of the window could thus be greatly reduced or even disappear completely depending on the vehicle equipment. This structure of conducting channels could, for example, be produced on two planes of the flexible printed circuit so that the antenna structures are provided with contacts which run along on one plane, and so that the connecting conductors are provided on at least another plane, including the mounting of the circuit elements and modules.

Such technology would markedly increase the flexibility of the work for customer-specific solutions because changes in the layout of such a conducting sheet will be less expensive than the measures which are expensive overall, for example, involving altering a screen-printing stencil.

It is also possible, as part of the standardization of window types, to conceive of FM, AM and UHF antennas to be incorporated into the glass using screen printing technology, and for GHz antenna systems for GSM and GPS to be incorporated directly into or onto the printed circuit.

Another embodiment may additionally comprise electronic sensors on the printed circuit, such as a dew detector, for example, in the form of a printed sinuous structure or a breakage detector, for example in the form of a conducting loop, which can be powered with a standby current which is interrupted in the event of breakage.

There may also be incorporated into the plane of the conductors of the contact element the current pick-up bars for the heating conductors for rear screens made of single-pane safety glass, which may once again be connected directly to the AM or FM signal processing means.

The contact element will have output leads for connection to the functional sets and elements provided on the bodywork, particularly a diversity operating circuit. These leads are preferably brought together at an interface so that a multiple connector can be used for later correction. If need be, for example to avoid mutual influence of the various flows of signals or of currents, it may also be conceivable to provide several interfaces of this type. In particular, it is also possible to use electro-optical coupling or optical coupling in place of purely electrical coupling, the interface then having to be equipped with corresponding light waveguides and the contact element possibly having to be equipped with electro-optical converters.

The contact element thus formed can be offered in the form of a flexible printed circuit or printed circuit sheet like a premounted comb of cables for the window, and which can, to a large extent, corresponding to the respective configuration of the electrical and/or electronic circuit elements, incorporate functions such as amplification operation, tuning, signal conversion, voltage distribution, etc., and all the internal connections of the conductors for the antenna and control signals and also, as appropriate, the supply voltages.

Common conductors for the control signals and conducting bars for distributing the voltage and earthing terminals and possibly softening terminals may also be provided for example. Furthermore, there may also be provided, in place of, or in addition to, electrical conductors, light waveguides for optical transmission of signals, electro-optical converters, possibly being provided as other circuit elements connected to the contact element.

In consequence, by the placing, the fixing and the placing in electrical contact of the contact element already equipped with the prefabricated electronic components, a multitude of, or even all of, the connection faces on the window are all placed in contact at once even though they do not have to be closely spaced as they were in the state of the art discussed in the introduction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
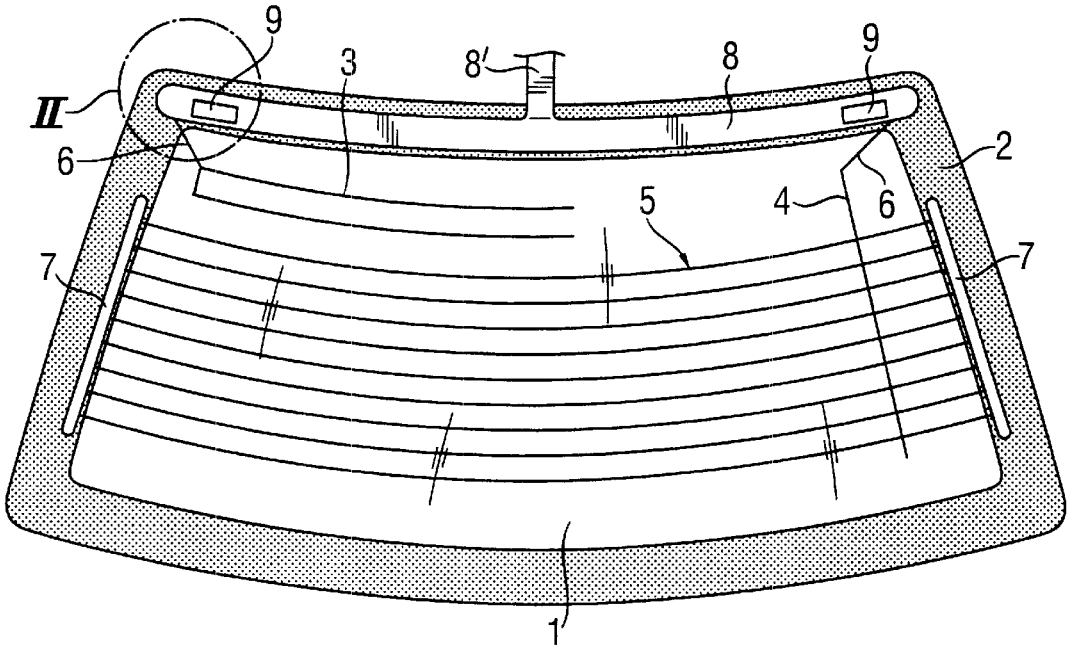
FIG. 1 shows a window with several functional electric elements and a contact element arranged along the upper edge of the window.

According to the embodiment shown in FIG. 1, a fixed transparent window 1 made of glass or plastic is equipped with a peripheral opaque edge band and with antenna elements 3, 4. A conventional heating area 5 is also provided on the window. The antenna elements 3, 4, their connection portions 6 and the heating area 5 and its common conductors 7 may be produced on the surface of a glass window by the conventional method of screen printing from a conducting slip and baked on when the window is heated to toughen it. In the mounted state, this surface faces the inside of a cabin where most of the opaque edging band is covered by the internal trim. The necessary electrical connections of the heating area 5 and of the two common conductors 7, are not described further here. They can be made with conventional individual connectors.

The connection portions 6 extend over the face of the window as far as the opaque edge band 2. Along the upper edge of the window 1 there is also, on the opaque edge band, a contact element 8 in the form of a flexible body or band which covers the ends of the connection portion 6. It serves, on the one hand, as a flat cable for electrical connection and linking of the functional electric elements placed on the window and, on the other hand, as a support for circuit elements 9 such as electronic modules, for example amplifiers, which are indicated here only schematically in the form of units. Approximately at the middle of the contact element 8 is shown an output lead 8' which may, in a way known per se, contain all the necessary external connections from the window to its functional electric elements. The external connections may, as required, be made by electrical, electro-optical or optical transmission of the signals. In particular, the output lead 8' may be represented as a common conductor which connects at least one signal converter/decoder arranged on the contact element with the on-board network.

Figure 2:
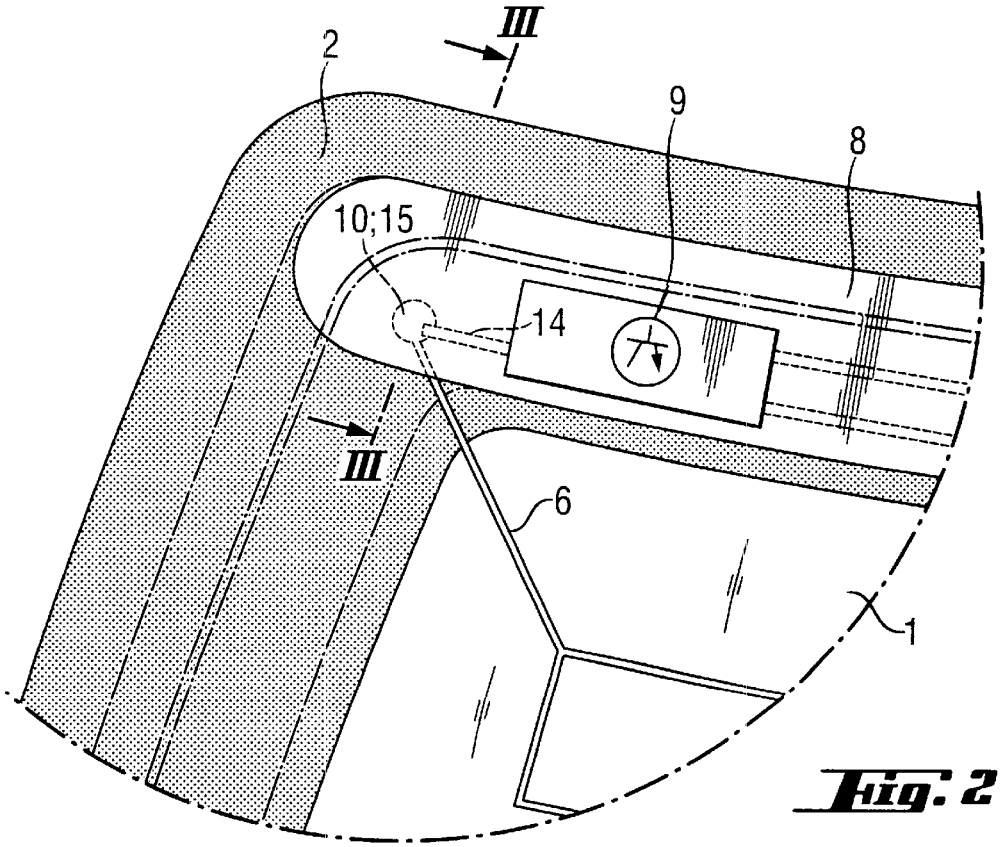
FIG. 2 depicts the upper left-hand corner of the window of FIG. 1 in detail.

FIG. 2 is a detail of the top left-hand corner of the window 1, showing the opaque edge band 2 and one of the connecting portions 6 which extends from the face of the window to the edge band 2, and in this instance ends in a contact face 10. The contact element 8 covers the contact face 10. One of the circuit elements 9 is on the contact element 8 in close proximity to the contact face 10, a conducting track 14 being shown in broken lines between the contact face 10 and the circuit element 9. This conducting track extends within the contact element 8, as will be discussed below, and ends in the contact face 10.

As a variation of the band-form of the contact element 8 in FIG. 1, it is also possible to use versions in the shape of an L or U, as already mentioned. FIG. 2 also indicates, by way of illustration in chain line, a continuation of the contact element 8 beyond the corner of the fixed window and an electrical conductor embedded in the contact element, which may be led into this continuation. Of course, several parallel conductors inside the contact element 8 could also be provided, as has been indicated in FIG. 2 to the right of the circuit element 9. These may, in this instance, for example be signalling and control conductors and distribution conductors for active antenna amplifiers or for the heating area 5, and for the common conductors 7, respectively. Thus, the contact element 8 forms a wiring harness for all of the functional electrical elements provided on the window 1. By suitable design, it may even replace the conventional individual connectors for the heating area 5.

Figure 3:
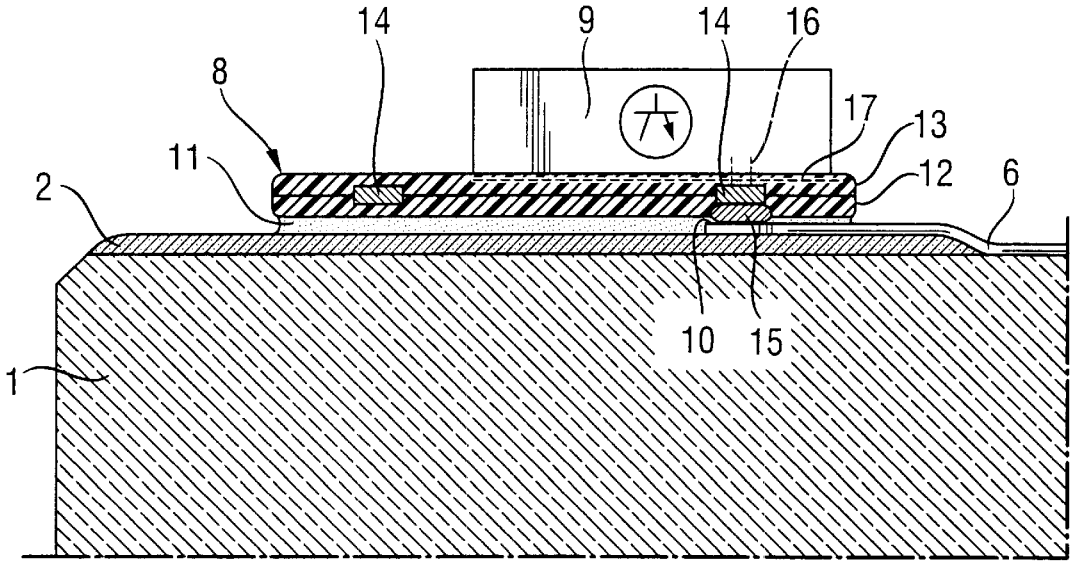
FIG. 3 is a cross section view of the detail in FIG. 2.

In the sectional view of FIG. 3, it is possible to see the vertical structure of the device in the area of the detail of FIG. 2. The base is the window 1, on the edge region of which the opaque edge band 2 is deposited. One of the connection portions 6 leaves the face of the window on the edge band 2, and in this instance ends in the contact face 10. A layer of adhesive 11 assembles the contact element 8 with the edge band. It extends over the underside of the contact element 8, and also over the region of the connection portion 6, but forms a cavity over the contact face 10.

In a way known per se, the contact element 8 is a laminate formed from several non-conducting thin bands of plastic 12, 13. The band 12 forming the underside is provided with the layer of adhesive 11. Embedded between the bands are conducting tracks 14 consisting of electrically conducting metal bands with transverse cross sections appropriate to the respective application, respectively for the electrical power (also known per se as multi-layer conductors). As a variation, it is also possible to embed in the contact element optical light waveguides, in addition to the appropriate adapters and connection terminals.

There is a cavity in the lower band of plastic 12 of the contact element 8 in the region of the contact face 10, and this cavity uncovers one of the conducting tracks 14 at this point. This track may also terminate here. At this point, a soldered connection 15 can be made between the conducting track 14 and the contact base 10. As a preference, the conducting track 14 is, for this purpose, pre-tinned at this point, as is the contact base 10 itself, as appropriate. At least the plastic band 13 of the upper face is made of a material such as polyimide, which can, without damage, withstand the influx of heat needed for properly soldering the soldered connection. There has also been shown an electrical connecting conductor 16 which leads from the conducting track 14 into the module 9. Also indicated is a strengthening insert 17 embedded in the upper band of plastic 13 of the contact element 8 under the circuit element unit 9.

If the corner region is made with a separate corner connector, as an alternative to the simplified depiction of FIG. 2, then the conducting track 14 will terminate therein and its electrical contact with the contact face 10 is made in the region covered by the corner connector. For this purpose it is possible to use a plug-in or push-button mechanical assembly.

In the case of application to an active window antenna, the contact face 10 forms the connector of the antenna concerned and the soldered assembly 15, the conducting track 14 and the connecting conductor 16 form a short ohmic coupling between the antenna and the circuit element 9 forming an amplifier.

It should be pointed out that he contact element depicted schematically here is a simple form of embodiment. If need be, several planes of conducting tracks or bands on top of each other may be provided, in a way known per se.

Obviously, numerous modifications and variations of the present invention are possible in light of the above teachings. It is therefore to be understood that within the scope of the appended claims, the invention may be practiced otherwise than as specifically described herein.

What is claimed is:

1. A window unit comprising:

a transparent window;

at least two functional electric elements mounted on said transparent window, each of the functional electric elements being provided with an electrical contact face arranged on the window near the edge of the window;

a flexible body mounted to the window at the edge of the window, the flexible body covering the contact faces;

at least two conductors insulated from one another and arranged in the flexible body; and at least one circuit element disposed on said flexible body;

wherein:

the conductors make electrical connection with at least one of said electrical contact faces and said circuit element; and the flexible body is mechanically strengthened in the region of points of attachment for the circuit element.

2. The window unit according to claim 1, wherein the flexible body extends along at least one side of the window parallel to the edge thereof.

3. The window unit according to claim 1, wherein the flexible body extends along at least two sides of the window parallel to the edges thereof.

4. The window unit according to claim 1, wherein the flexible body has an output lead.

5. The window unit according to claim 4, wherein the output lead is a common conductor associated with at least one signal matcher/decoder arranged on the flexible body.

6. The window unit according to claim 1, wherein the flexible body has a flat side which faces towards the window and is coated with an adhesive.

7. The window unit according to claim 1, wherein the flexible body has conductor connecting faces that are precoated with a soldering agent or an adhesive.

8. The window unit according to claim 1, wherein the flexible body has conductor connecting faces which are mechanically held in electrical contact with contact faces of the window.

9. The window unit according to claim 1, wherein the flexible body is equipped with positioning accessories to assist with mounting it in the correct position on the window.

10. The window unit according to claim 9, wherein the positioning accessories comprise stops assembled with the contact faces, and which are applied to the front edge face of the window.

11. The window unit according to claim 10, wherein the stops are connected to the flexible body by areas of lesser strength.

12. The window unit according to claim 1, wherein the flexible body is itself a support for antenna structures suitable for the GHz range of frequencies.

13. The window unit according to claim 1, further comprising at least one insert disposed in the flexible body to mechanically strengthen in the region of points of attachment for the circuit element.

14. A window unit comprising:

a transparent window mounted in a vehicle;

at least two antennas mounted on said transparent window, each of the antennas being provided with an electrical contact face arranged on the window near the edge of the window;

a flexible body mounted to the window at the edge of the window, the flexible body covering the electrical contact faces;

at least two conductors insulated from one another and arranged in the flexible body; and at least one circuit element disposed on said flexible body, wherein the conductors make electrical connection with at least one of said electrical contact faces and said circuit element;

wherein the flexible body is mechanically strengthened in the region of points of attachment for the circuit element.

15. The window unit according to claim 14, wherein the flexible body is fixed to a face of the window facing towards the interior of the vehicle at a predetermined distance away from the edge of this window.

16. The window unit according to claim 14, wherein the flexible body is arranged on the face of an opaque colored band extending along the edge of the window.

17. The window unit according to claim 14, further comprising at least one insert disposed in the flexible body to mechanically strengthen in the region of points of attachment for the circuit element.

18. A connecting device in a window unit comprising a transparent window and at least two functional electric elements mounted on said transparent window, each of the functional electric elements being provided with an electrical contact face arranged on the window near the edge of the window, the connecting device comprising:

a body mounted to the window at the edge of the window, the body covering the contact faces;

at least two conductors insulated from one another and arranged in the body; and at least one circuit element disposed on said body;

wherein:

the conductors make electrical connection with at least one of said electrical contact faces and said circuit element; and the body is a flexible body comprised of a laminate of at least two bands.

19. The connecting device according to claim 18, wherein the electrical contact faces are arranged in a corner of the window.

20. The window unit according to claim 18, further comprising at least one insert disposed in the flexible body to mechanically strengthen in the region of points of attachment for the at least one circuit element.

21. The widow unit according to claim 1, wherein the electrical contact faces are distributed along the edge of the window and connected by the flexible body which has a shape tailored to the edge of the window.

22. The widow unit according to claim 14, wherein the electrical contract faces are distributed along the edge of the windows and connected to the flexible body which has a shape tailored to the edge of the window.

* * * * *